US010226805B2

(12) United States Patent
Choi et al.

(10) Patent No.: US 10,226,805 B2
(45) Date of Patent: Mar. 12, 2019

(54) CAM TYPE PRESS

(71) Applicant: KIA MOTORS CORPORATION, Seoul (KR)

(72) Inventors: Hee Kwan Choi, Hwaseong-si (KR); Sang Dong Kim, Gunpo-si (KR); Jeung Hwan Kim, Suwon-si (KR)

(73) Assignee: KIA MOTORS CORPORATION, Seoul (KR)

( * ) Notice: Subject to any disclaimer, the term of this patent is extended or adjusted under 35 U.S.C. 154(b) by 640 days.

(21) Appl. No.: 14/955,992

(22) Filed: Dec. 1, 2015

(65) Prior Publication Data

US 2016/0303633 A1 Oct. 20, 2016

(30) Foreign Application Priority Data

Apr. 20, 2015 (KR) ..... 10-2015-00055448

(51) Int. Cl.

| | |
|---|---|
| ***B21D 37/08*** | (2006.01) |
| ***B21D 19/08*** | (2006.01) |
| ***B21D 37/12*** | (2006.01) |
| ***B21D 24/04*** | (2006.01) |
| ***B21D 37/04*** | (2006.01) |
| ***B21D 53/88*** | (2006.01) |

(52) U.S. Cl.

CPC ..... *B21D 19/084* (2013.01); *B21D 24/04* (2013.01); *B21D 37/04* (2013.01); *B21D 37/08* (2013.01); *B21D 37/12* (2013.01); *B21D 53/88* (2013.01)

(58) Field of Classification Search

CPC ..... B21D 19/084; B21D 37/12; B21D 37/08; B21D 24/04; B21D 37/04; B21D 53/88

USPC ..... 72/452.9

See application file for complete search history.

(56) References Cited

U.S. PATENT DOCUMENTS

| | | | | |
|---|---|---|---|---|
| 7,243,524 | B2 * | 7/2007 | Kinoshita | B21D 5/04 72/315 |
| 7,665,341 | B2 | 2/2010 | Kinoshita | |
| 9,321,094 | B2 * | 4/2016 | Choi | B21D 24/04 |

FOREIGN PATENT DOCUMENTS

| | | | |
|---|---|---|---|
| JP | H07-003827 | U | 1/1995 |
| JP | 2542106 | | 10/1996 |
| JP | H11-90541 | | 4/1999 |
| JP | 2004-4337900 | A | 12/2004 |
| KR | 20-1999-007443 | | 2/1999 |
| KR | 10-2003-0084313 | A | 11/2003 |
| KR | 10-2009-0046676 | A | 5/2009 |
| KR | 10-1229765 | | 2/2013 |

* cited by examiner

*Primary Examiner* — David B Jones
(74) *Attorney, Agent, or Firm* — Brinks Gilson & Lione

(57) ABSTRACT

Provided is a cam type press capable of controlling deformation of a flange of a panel in the course of processing the flange, thus reducing deformation such as a crease, or the like, of the flange. The cam type press includes a padding cam installed to be movable in a slope direction. A slider is installed to be movable toward the padding cam, with a process gap into which a portion of a panel is inserted to form a flange between one side of the padding cam and one side of the slider. An adjustment block adjusts the process gap provided between the other side of the padding cam and the other side of the slider.

10 Claims, 4 Drawing Sheets

CAM TYPE PRESS

CROSS-REFERENCE TO RELATED APPLICATIONS

This application claims the benefit of Korean Patent Application No. 10-2015-0055448, filed on Apr. 20, 2015, which is hereby incorporated by reference in its entirety.

FIELD

The present disclosure relates to a cam type press.

BACKGROUND

The statements in this section merely provide background information related to the present disclosure and may not constitute prior art.

In general, vehicle panels are manufactured through multi-stage pressing, and in order to perform the process, various types of press apparatuses are used.

In particular, a cam type press having a cam type structure is used to form a panel with a flange at a predetermined angle. The cam type press includes an upper die operated to be lifted and lowered in an upper portion thereof and a lower die supporting a material panel in a lower portion thereof.

Cam units such as a cam driver and a cam slider operated by the cam driver are disposed between the upper die and the lower die, and the upper die and the lower die are configured to process a flange at one side of the panel through operations of the cam units.

SUMMARY

An aspect of the present disclosure provides a cam type press capable of reducing deformation such as a crease in a flange of a panel by controlling deformation of the flange in the course of processing the flange, thus enhancing surface quality of the flange.

According to an exemplary form of the present disclosure, a cam type press includes: a padding cam installed to be movable in a slope direction; and a slider installed to be movable toward the padding cam, wherein a process gap into which a portion of a panel is inserted to process a flange is formed between one side of the padding cam and one side of the slider, and an adjustment block adjusting the process gap is provided between the other side of the padding cam and the other side of the slider.

A first bending inducing surface may be formed at one side of the padding cam, a second bending inducing surface facing the first bending inducing surface may be formed at one side of the slider, and the process gap may be formed between the first bending inducing surface and the second bending inducing surface.

The padding cam may be configured to be moved in the slope direction by a driver, and the slider may be configured to be moved in the slope direction toward the padding cam.

The panel may be supported by a support die, the driver may be vertically moved according to a vertical movement of the support die, and as vertical movement power of the driver is transmitted to the padding cam through a transmission unit, the padding cam may be moved in the slope direction.

The transmission unit may include a horizontal movement block moved in a horizontal direction according to a vertical movement of the driver and a slope movement block moved in a slope direction by the horizontal movement block.

The driver may have a first sloped surface and a first vertical surface, and the horizontal movement block may have a second sloped surface in contact with the first sloped surface of the driver and a second vertical surface in contact with the first vertical surface of the driver.

The horizontal movement block may have a third sloped surface formed on the opposite side of the second sloped surface, and the slope movement block may have a fourth sloped surface in contact with the third sloped surface of the horizontal movement block.

A wear plate may be interposed between the fourth sloped surface of the slope movement block and the third sloped surface of the horizontal movement block.

The slope movement block may have a flange processing part formed to be adjacent to the padding cam, and the flange processing part may have a support surface supporting one side of a panel and a first flange processing surface formed to cross the support surface at a predetermined angle.

The flange processing part may protrude slantingly at an angle corresponding to the slope movement direction of the slope movement block, and the padding cam may be installed to be movable in the slope direction in the slope movement block.

The slider may be installed to be movable in the slope direction on the opposite side of the padding cam, the slider may have a second flange processing surface formed to cross the second bending inducing surface at a predetermined angle, and the second flange processing surface of the slider may be formed to correspond to the first flange processing surface of the flange processing part.

The first flange processing surface of the flange processing part and the second flange processing surface of the slider may be formed to be flat in a direction in which the flange is processed.

The padding cam may be elastically supported by at least one gas spring installed within the slope movement block.

At least one gas spring may have a cylinder and a rod moving forward and backward with respect to the cylinder, the cylinder may be fixed to the slope movement block, and an outer end of the rod may be configured to press or support the padding cam.

A stopper may be installed on one side of the slope movement block and may be configured to regulate a rising position of the padding cam lifted by at least one gas spring to be within a predetermined range.

According to another form of the present disclosure, a cam type press includes: a driver; a padding cam moved in a slope direction by the driver; and a slider provided to be movable in the slope direction toward the padding cam, wherein a process gap into which a portion of a panel is inserted to process a flange is formed between one side of the padding cam and one side of the slider, and an adjustment block adjusting the process gap is provided between the other side of the padding cam and the other side of the slider.

A first bending inducing surface may be formed at one side of the padding cam, a second bending inducing surface facing the first bending inducing surface may be formed at one side of the slider, and the process gap into which a portion of the panel is inserted to process the flange may be formed between the first bending inducing surface and the second bending inducing surface.

According to another form of the present disclosure, a cam type press includes: a driver installed to be movable vertically; a transmission unit cooperatively operated by the driver; a padding cam installed to be movable in a slope direction in the transmission unit; and a slider provided to be movable in the slope direction toward the padding cam, wherein a vertical movement of the driver is transmitted to the padding cam through the transmission unit to allow the padding cam to be moved in the slope direction, a first bending inducing surface is formed at one side of the padding cam, a second bending inducing surface facing the first bending inducing surface is formed at one side of the slider, a process gap into which a portion of a panel is inserted to process a flange is formed between the first bending inducing surface and the second bending inducing surface, and an adjustment block adjusting the process gap is provided between the other side of the padding cam and the other side of the slider.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 3:
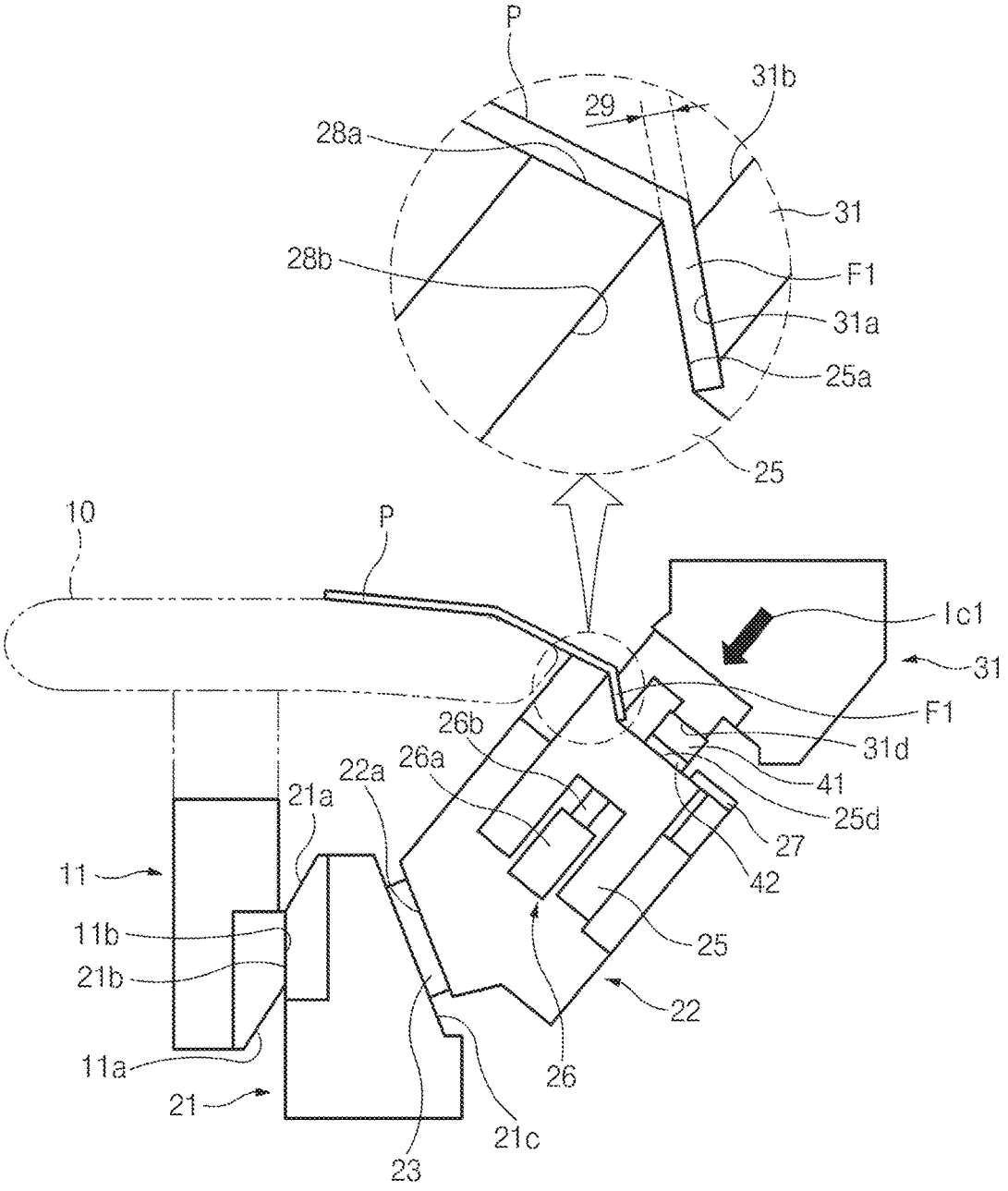
Figure 4:
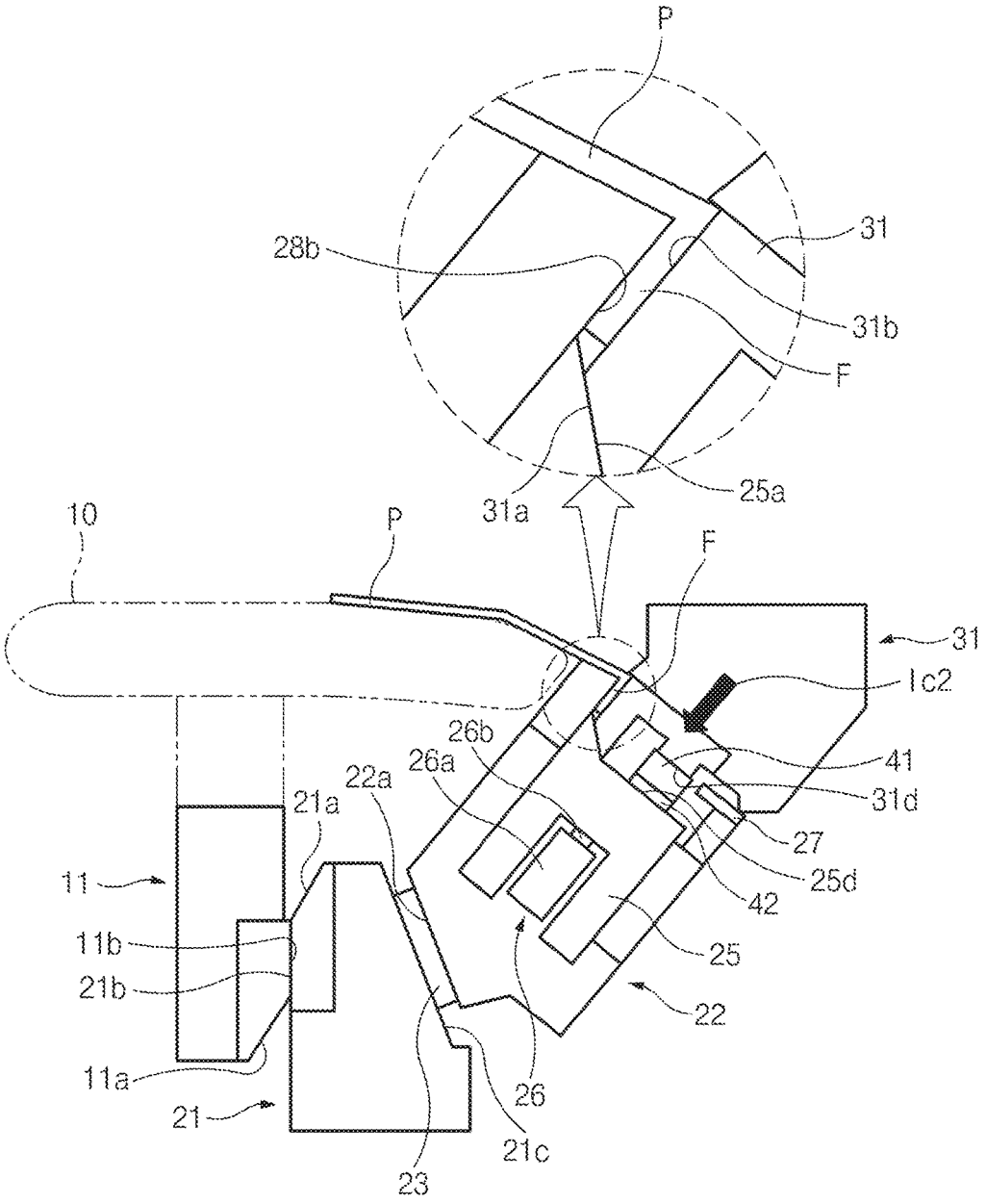

FIG. 3 is a view illustrating a process in which a portion of a panel is bent as a slider moves downwardly in a slope direction toward a padding cam in the cam type press according to one form of the present disclosure; and FIG. 4 is a view illustrating a state in which a flange of the panel is processed through a cooperative operation between the slider and the padding cam in the cam type press according to one form of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features.

For reference, dimensions of elements or thicknesses of lines illustrated in the drawings referred to describe the present disclosure may be exaggerated for the convenience of understanding. Also, the terms used henceforth have been defined in consideration of the functions of the present disclosure, and may be altered according to the intent of a user or operator, or conventional practice. Therefore, the terms should be defined on the basis of the entire content of this specification.

Figure 1:
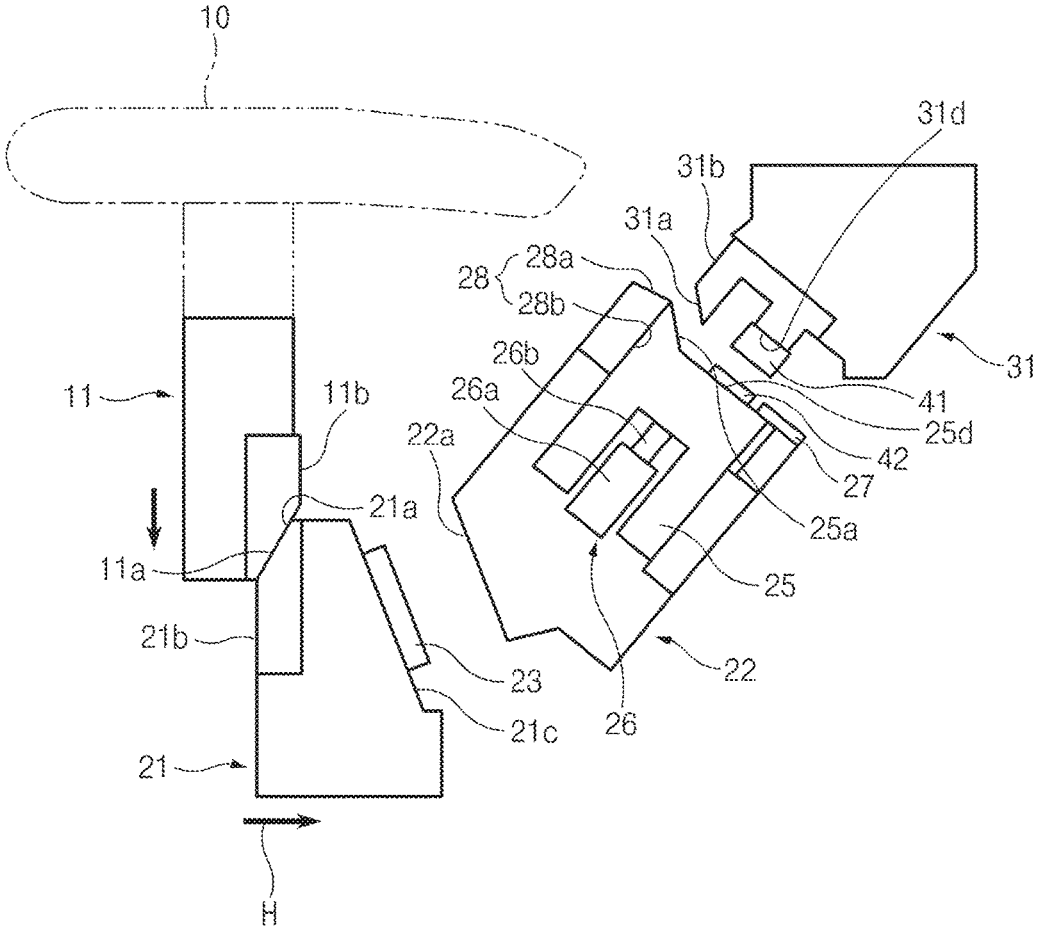
FIG. 1 is a cross-sectional view illustrating a cam type press according to one form of the present disclosure.

FIG. 1 is a cross-sectional view illustrating a cam type press according to one form of the present disclosure.

Referring to FIG. 1, the cam type press includes a driver 11, a transmission unit 21, 22 interlocked by the driver 11, a padding cam 25 operated by the driver 11 and the transmission unit 21, 22, and a slider 31 provided to be movable toward the padding cam 25.

The driver 11 is provided below a support die 10 and installed to be cooperatively movable in a vertical direction according to a vertical movement of the support die 10. A panel P, which is a processing target, is supportedly placed on an upper surface of the support die 10. With the panel P placed on the upper surface of the support die 10, when the support die 10 moves vertically in a downward direction, the driver 11 is also moved vertically in the downward direction, and the padding cam 25 and the slider 31 may cooperate with each other to bend a portion F1 of the panel P according to the downward and vertical movement of the driver 11.

In one form, the driver 11 has a first sloped surface 11*a* and a first vertical surface 11*b* formed in a lower portion thereof.

The transmission unit 21, 22 is configured to be cooperatively operated by the driver 11 to transmit a vertical movement power of the driver 11 to the padding cam 25.

As illustrated in FIG. 1, the transmission unit 21, 22 according to an one form has a horizontal movement block 21 moved in a horizontal direction according to the vertical movement of the driver 11 and a slope movement block 22 moved in a slope direction by the horizontal movement block 21.

Figure 2:
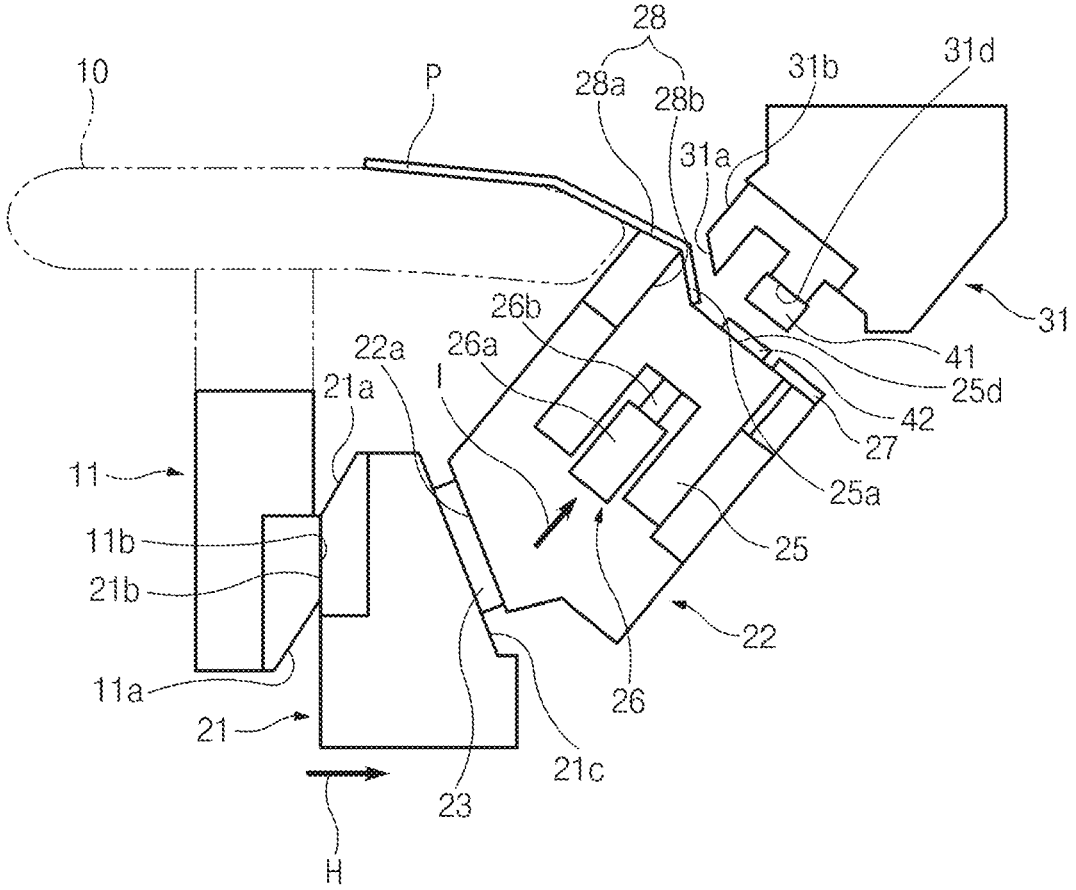
FIG. 2 is a view illustrating a process in which a horizontal movement block and a slope movement block are moved in the cam type press according to one form of the present disclosure.

A second sloped surface 21*a* and a second vertical surface 21*b* are formed on one side of the horizontal movement block 21. The second sloped surface 21*a* may be in contact with the first sloped surface 11*a* of the driver 11, and the second vertical surface 21*b* may be in contact with the first vertical surface 11*b*. Thus, as illustrated in FIG. 1, in a state in which the first sloped surface 11*a* of the driver 11 and the second sloped surface 21*a* of the horizontal movement block 21 are in contact with each other, when the driver 11 moves in a downward direction, the horizontal movement block 21 is moved to one side in a horizontal direction (referred to as the H direction indicated by the arrow in FIG. 2), and when the driver 11 continuously moves in the downward direction as illustrated in FIG. 2, the first vertical surface 11*b* of the driver 11 and the second vertical surface 21*b* of the horizontal movement block 21 are brought into contact with each other and the horizontal movement position of the horizontal movement block 21 is uniformly maintained by the driver 11.

A third sloped surface 21*c* is formed on the other side of the horizontal movement block 21. The third sloped surface 21*c* is formed opposite to the second sloped surface 21*a* to guide a slope directional movement of the slope movement block 22.

The slope movement block 22 is installed to be moved in the slope direction by the horizontal movement block 21. A fourth sloped surface 22*a* is formed on one side of the slope movement block 22 and is in contact with the third sloped surface 21*c* of the horizontal movement block 21. In a state in which the fourth sloped surface 22*a* of the slope movement block 22 is in contact with the third sloped surface 21*c* of the horizontal movement block 21, when the horizontal movement block moves to one side in the horizontal direction (referred to as the H direction indicated by the arrow in FIG. 2), the slope movement block 22 may be moved in a predetermined slope direction (referred to as the I direction indicated by the arrow in FIG. 2).

A wear plate 23 is interposed between the fourth sloped surface 22*a* of the slope movement block 22 and the third sloped surface 21*c* of the horizontal movement block 21. By virtue of the wear plate 23, the fourth sloped surface 22*a* of the slope movement block 22 and the third sloped surface 21*c* of the horizontal movement block 21 may more smoothly come into contact with each other.

A flange processing part 28 is formed on an upper portion at one side of the slope movement block 22 and protrudes slantingly at an angle corresponding to the slope movement direction of the slope movement block 22. The flange processing part 28 has a support surface 28*a* supporting one side of the panel P and a first flange processing surface 28*b* crossing the support surface 28*a* at a predetermined angle.

The padding cam 25 is installed on the transmission unit 21, 22, and a first bending inducing surface 25*a* is formed at one side of the padding cam 25.

The padding cam 25 is installed to be movable in the slope direction from an upper side of the slope movement block 22 and elastically supported by at least one gas spring 26 installed within the slope movement block 22. The gas spring 26 has a cylinder 26*a* and a rod 26*b* moving forward and backward with respect to the cylinder 26*a*. The cylinder 26*a* is fixed to the slope movement block 22, and an outer end of the rod 26*b* is configured to press or support the padding cam 25. Thus, when external force applied to the padding cam 26 is removed, the padding cam 25 may be lifted upwardly in the slope direction by the gas spring 26.

A stopper 27 is installed on one side of the slope movement block 22 and serves to regulate a rising position of the padding cam 25 lifted by the gas spring 26 to be within a predetermined range.

The slider 31 is installed to be movable in the slope direction on the opposite side of the padding cam 25. The slider 31 has a second bending inducing surface 31*a* facing the first bending inducing surface 25*a* of the padding cam 25 and a second flange processing surface 31*b* formed to cross the second bending inducing surface 31*a* at a predetermined angle. The second flange processing surface 31*b* of the slider 31 is formed to correspond to the first flange processing surface 28*b* of the flange processing part 28, and here, the second flange processing surface 31*b* of the slider 31 and the first flange processing surface 28*b* of the flange processing part 28 may be formed to be flat in a process direction corresponding to formation of a flange F as described hereinafter to thereby further stabilize surface quality of the processed flange F.

As illustrated in FIGS. 3 and 4, when the padding cam 25 and the slider 31 move downwardly in the slope direction, the first bending inducing surface 25*a* of the padding cam 25 and the second bending inducing surface 31*a* of the slider 31 may cooperatively bend a portion F1 of a panel P to thereby precisely process the flange F.

In order to facilitate processing of the flange F according to the downward slope direction of the slider 31 and the padding cam 25, the first bending inducing surface 25*a* of the padding cam 25 and the second bending inducing surface 31*a* of the slider 31 are sloped to correspond to each other. Thus, after the portion F1 of the panel P is inserted into a process gap 29 between the first and second bending inducing surfaces 25*a* and 31*a* as illustrated in FIG. 3, when the slider 31 and the padding cam 25 successively move downwardly in the slop direction, the first and second bending inducing surfaces 25*a* and 31*a* gradually press and bend the portion F1 as illustrated in FIG. 4. After the movement of the slider 31 and the padding cam 25 in the downward slope direction, the portion F1 is finally inserted between the first flange processing surface 28*b* of the processing part 28 and the second flange processing surface 31*b* of the slider 31, whereby bending is completed and the flange F is processed.

The process of processing the flange F of the panel P will be described in detail with reference to FIGS. 2 through 4.

First, when the panel P is placed on an upper surface of the support die 10 as illustrated in FIG. 2, one side of the panel P is supported by the support surface 28*a* of the flange processing part 28, and the portion F1 of the panel P is placed on the first bending inducing surface 25*a* of the padding cam 25.

Next, as illustrated in FIG. 3, as the slider 31 moves toward the padding cam 25 (referred to as the IC1 direction indicated by the arrow in FIG. 3), the process gap 29 is formed between the first bending inducing surface 25*a* of the padding cam 25 and the second bending inducing surface 31*a* of the slider 31 and the portion F1 of the panel P is inserted into the process gap 29.

In a state in which the portion F1 of the panel P is inserted into the process gap 29, when the slider 31 further moves downwardly in the slope direction (referred to as the IC2 direction indicated by the arrow in FIG. 4) as illustrated in FIG. 4, the second bending inducing surface 31*a* of the slider 31 pushes the first bending inducing surface 25*a* of the padding cam 25 downwardly in the slope direction and the rod 26*b* of the gas spring 26 is moved backward according to the movement of padding cam 25 in the downward slope direction. Also, since the second bending inducing surface 31*a* of the slider 31 and the first bending inducing surface 25*a* of the padding cam 25 cooperate with each other, the portion F1 of the panel P is gradually bent and finally inserted into the process gap 29 between the first flange process surface 28*b* of the flange processing part 28 and the second flange process surface 31*b* of the slider 31, thus completing processing of the flange F.

In particular, in the present disclosure, an adjustment block 41 is interposed between a flat surface 25*d* of the padding cam 25 and a flat surface 31*d* of the slider 31, and here, the adjustment block 41 may be detachably installed on the flat surface 25*d* of the padding cam 25 or the flat surface 31*d* of the slider 31. The process gap 29 between the first bending inducing surface 25*a* of the padding cam 25 and the second bending inducing surface 31*a* of the slider 31 may be appropriately adjusted by the adjustment block 41, and accordingly, pressing and bending of the portion F1 of the panel P may be controlled, reducing occurrence of deformation such as a crease, or the like, when the flange F of the panel P is processed, and thus, surface quality of the flange F may be further enhanced.

According to one form, a plurality of adjustment blocks 41 having different thicknesses may be provided and selectively interposed between the flat surface 25*d* of the padding cam 25 and the flat surface 31*d* of the slider 31 according to a thickness and a material of the panel P, whereby the process gap 29 between the padding cam 25 and the slider 31 may be very precisely adjusted.

According to another form, the adjustment block 41 and one or more adjustment members 42 may be interposed between the flat surface 25*d* of the padding cam 25 and the flat surface 31*d* of the slider 31, and here, the process gap 29 between the padding cam 25 and the slider 31 may be variously adjusted by selectively applying the one or more adjustment members 42 according to a thickness and a material of the panel P.

As described above, according to various forms of the present disclosure, deformation of the flange of the panel may be controlled in the course of processing the flange by adjusting a process gap for processing the flange of the panel by virtue of the adjustment block, whereby deformation, such as a crease, of the flange may be reduced, and thus, surface quality of the flange may be enhanced.

The present disclosure described above may be variously substituted, altered, and modified by those skilled in the art to which the present disclosure pertains without departing from the scope and sprit of the present disclosure. Therefore, the present disclosure is not limited to the above-mentioned forms and the accompanying drawings.

What is claimed is:

1. A cam type press comprising:

a support die supporting a panel;

a driver being cooperatively vertically movable according to a vertical movement of the support die, the driver having a first sloped surface and a first vertical surface;

a padding cam installed to be movable in a slope direction;

a slider installed to be movable toward the padding cam;

a transmission unit including a horizontal movement block moved in a horizontal direction by the driver and a slope movement block moved in a slope direction by the horizontal movement block; and an adjustment block disposed between the padding cam and the slider;

wherein a process gap into which a portion of a panel is inserted to process a flange is formed between the padding cam and the slider, and the process gap is adjusted by the adjustment block, wherein the horizontal movement block has a second sloped surface in contact with the first sloped surface of the driver and a second vertical surface in contact with the first vertical surface of the driver, and wherein the horizontal movement block has a third sloped surface and the slope movement block has a fourth sloped surface in contact with the third sloped surface of the horizontal movement block.

2. The cam type press according to claim 1, wherein the padding cam has a first bending inducing surface, the slider has a second bending inducing surface facing the first bending inducing surface, and the process gap is formed between the first bending inducing surface and the second bending inducing surface.

3. The cam type press according to claim 1, further comprising a wear plate attached the third sloped surface of the horizontal movement block, wherein the wear plate has a wear surface contacting the fourth sloped surface of the slope movement block.

4. The cam type press according to claim 3, wherein the slope movement block has a flange processing part formed to be adjacent to the padding cam, and the flange processing part has a support surface supporting a panel and a first flange processing surface formed to cross the support surface at a predetermined angle.

5. The cam type press according to claim 4, wherein the flange processing part protrudes at an angle corresponding to the slope direction of the slope movement block, and the padding cam is installed to be movable in the slope direction in the slope movement block.

6. The cam type press according to claim 5, wherein the slider is installed to be movable in the slope direction on an opposite side of the padding cam, the slider has a second flange processing surface formed to cross the second bending inducing surface at a predetermined angle, and the second flange processing surface of the slider is formed to correspond to the first flange processing surface of the flange processing part.

7. The cam type press according to claim 6, wherein the first flange processing surface of the flange processing part and the second flange processing surface of the slider are formed to be flat in a direction in which the flange is processed.

8. The cam type press according to claim 5, wherein the padding cam is elastically supported by at least one gas spring installed within the slope movement block.

9. The cam type press according to claim 8, wherein the at least one gas spring has a cylinder and a rod moving forward and backward with respect to the cylinder, the cylinder is fixed to the slope movement block, and an outer end of the rod is configured to press or support the padding cam.

10. The cam type press according to claim 8, wherein a stopper is installed on the slope movement block and is configured to regulate a rising position of the padding cam lifted by at least one gas spring to be within a predetermined range.

* * * * *